US011678697B2

(12) United States Patent
Lisan et al.

(10) Patent No.: US 11,678,697 B2
(45) Date of Patent: Jun. 20, 2023

(54) TOBACCO SMOKE FILTER

(71) Applicant: ESSENTRA FILTER PRODUCTS DEVELOPMENT CO. PTE. LTD, Singapore (SG)

(72) Inventors: Ahmad Fashihul Lisan, Surabaya (ID); Roy Alingalan, Singapore (SG); Pakorn Aewskulrat, Bangkok (TH)

(73) Assignee: Essentra Filter Products Development Co. Pte. Ltd., Singapore (SG)

( * ) Notice: Subject to any disclaimer, the term of this patent is extended or adjusted under 35 U.S.C. 154(b) by 754 days.

(21) Appl. No.: 14/418,501

(22) PCT Filed: Jul. 31, 2013

(86) PCT No.: PCT/EP2013/066064
§ 371 (c)(1),
(2) Date: Jan. 30, 2015

(87) PCT Pub. No.: WO2014/020055
PCT Pub. Date: Feb. 6, 2014

(65) Prior Publication Data

US 2015/0181929 A1 Jul. 2, 2015

(30) Foreign Application Priority Data

Aug. 1, 2012 (GB) ..... 1213786.5

(51) Int. Cl.
*A24D 3/06* (2006.01)
*A24D 3/04* (2006.01)
(Continued)

(52) U.S. Cl.
CPC ..... *A24D 3/062* (2013.01); *A24D 3/04* (2013.01); *A24D 3/043* (2013.01); *A24D 3/048* (2013.01); *A24D 3/10* (2013.01); *A24D 3/163* (2013.01)

(58) Field of Classification Search
CPC ..... A24D 3/043; A24D 3/062; A24D 3/10; A24D 3/163; A24D 3/00; A24D 3/17;
(Continued)

(56) References Cited

U.S. PATENT DOCUMENTS 4,256,122 A 3/1981 Johnson
4,585,015 A * 4/1986 Silberstein ..... A24D 3/043 131/338

(Continued)

FOREIGN PATENT DOCUMENTS

EP 0 060 488 A1 9/1982
EP 1 797 780 A1 6/2007

(Continued)

OTHER PUBLICATIONS

Oxford English Dictionary, https://www.oed.com/view/Entry/59504?isAdvanced=false&result=1&rskey=kWAn5n&.*

(Continued)

*Primary Examiner* — Galen H Hauth
*Assistant Examiner* — Yana B Krinker
(74) *Attorney, Agent, or Firm* — Flynn Thiel, P.C.

(57) ABSTRACT

A tobacco smoke filter or filter element comprising a stiff outer wrapper engaged around a downstream thermoformed core of tobacco smoke filtering material and a further core longitudinally aligned therewith; the downstream thermoformed core having a profiled outer surface which defines with the stiff outer wrapper at least one longitudinally extending channel which extends the length of the downstream core.

19 Claims, 2 Drawing Sheets

Figure 1:
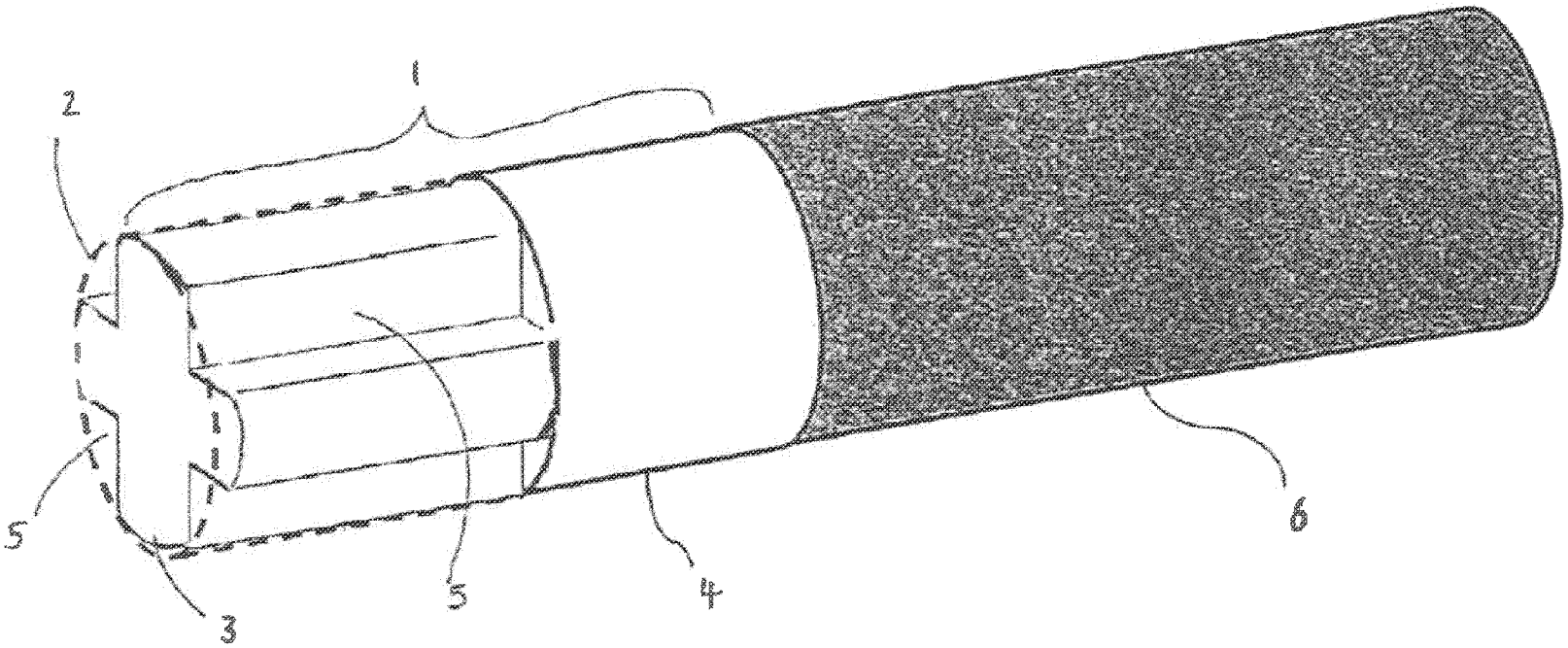

(51) Int. Cl.
*A24D 3/10* (2006.01)
*A24D 3/16* (2006.01)

(58) Field of Classification Search
CPC ..... A24D 3/041; A24D 3/045; A24D 3/046; A24D 3/04–048; A24C 5/52
See application file for complete search history.

(56) References Cited

U.S. PATENT DOCUMENTS

| | | | | | |
|---|---|---|---|---|---|
| 4,807,647 | A * | 2/1989 | Hayes | A24D 3/043 131/336 |
| 5,979,459 | A * | 11/1999 | Schneider | A24D 3/043 131/338 |
| 2006/0011206 | A1 * | 1/2006 | Clarke | A24D 3/04 131/338 |
| 2011/0120481 | A1 * | 5/2011 | Besso | A24D 3/0212 131/275 |

FOREIGN PATENT DOCUMENTS

| | | | | |
|---|---|---|---|---|
| GB | 2 098 051 | A | 11/1982 | |
| GB | 2 102 271 | A | 2/1983 | |
| GB | 2 116 824 | A | 10/1983 | |
| GB | 2 135 168 | A | 8/1984 | |
| GB | 2 170 695 | A | 8/1986 | |
| WO | WO 2008/043988 | A1 | 4/2008 | |
| WO | WO2008043988 | * | 4/2008 | A24D 1/02 |
| WO | WO 2009/144496 | A1 | 12/2009 | |
| WO | WO 2010/115675 | A1 | 10/2010 | |
| WO | WO-2011117584 | A1 * | 9/2011 | A24D 3/0291 |
| WO | WO 2011/148130 | A1 | 12/2011 | |
| WO | WO-2012123702 | A1 * | 9/2012 | A24D 3/04 |

OTHER PUBLICATIONS

International Search Report issued in Appln. No. PCT/EP2013/066064 dated Dec. 5, 2013 (5 pages).
UK Patent Office Search Report issued in Application No. GB1213786.5 dated Nov. 27, 2012 (7 pages).

* cited by examiner

TOBACCO SMOKE FILTER

The present invention relates to tobacco smoke filters and filter elements, for example for smoking articles such as cigarettes.

So called "Actron" type tobacco smoke filters are well known (e.g. see U.S. Pat. No. 4,256,122) These include a core of thermoformed cellulose acetate material which includes part-length external grooves, and a non-porous core wrapper which follows the profile of these grooves. The filter includes a ventilated outer wrapper which allows ventilating air to enter the external grooves and flow along the external grooves into the mouth of the smoker, along with smoke which is drawn through the core of cellulose acetate material. The non porous core wrapper prevents ventilating air from entering the cellulose acetate core and there is, therefore, no mixing of air and smoke in the filter. These filters are prone to crushing of the ventilated outer wrapper into the grooves (e.g. during cigarette manufacture and/or by the mouth of the smoker in use). Further, the so-called "air and smoke" effect caused by the lack of mixing of air and smoke in the filter may lead to an inferior taste sensation.

Other filters with a grooved wrap or profile can also suffer from crushing during processing and handling.

There is a need for a tobacco smoke filter which does not have these disadvantages.

According to the present invention there is provided a tobacco smoke filter (or filter element) comprising a stiff outer wrapper engaged around a downstream (longitudinally extending) thermoformed core of tobacco smoke filtering material and a further (longitudinally extending e.g. substantially cylindrical) core (e.g. of tobacco smoke filtering material) longitudinally aligned therewith; the downstream thermoformed core having a profiled (e.g. grooved e.g. corrugated) outer surface which defines with the (inner surface of the) stiff outer wrapper at least one (e.g. covered) longitudinally extending channel which extends (e.g. continuously) the (full) length of the downstream core. The further core of tobacco smoke filtering material is longitudinally aligned with the downstream thermoformed core of tobacco smoke filtering material. The further core of tobacco smoke filtering material is upstream of the downstream thermoformed core of tobacco smoke filtering material. Preferably, the (downstream end of the) further core of tobacco smoke filtering material is longitudinally aligned with, and abutted to, the (upstream end of the) downstream thermoformed core of tobacco smoke filtering material.

Herein the term "downstream" means towards the end of the filter/filter element/filter cigarette which is closest to the mouth of the smoker of a filter cigarette (e.g. when the filter/filter element is attached to a tobacco envelope in a filter cigarette). The term "upstream" means towards the end of the filter/filter element which is closest to the tobacco envelope of the filter cigarette (e.g. when the filter/filter element is attached to a tobacco envelope in a filter cigarette).

Herein, the term "thermoformed core" means a core which has been shaped or moulded into a coherent, self supporting, core using the action of heat on the tobacco smoke filtering material (and optional other components such as plasticiser).

Preferably the stiff outer wrapper comprises a stiff paper, for example a stiff plugwrap paper. The stiff outer wrapper may be a paper (e.g. plugwrap paper) of basis weight from about 80 to 120 gsm. The stiff outer wrapper may be a paper (e.g. plugwrap paper) of lighter weight, for example of basis weight 30 to 80 gsm, to which additives have been applied to make it stiff, or which has been processed or formulated to create a stiffer structure than conventional plug wrap papers, as is well known in the art. Stiff papers, for example stiff plugwrap papers, are well known in the art.

Preferably the downstream thermoformed core does not include a further wrapper (e.g. air impermeable wrapper) following the profile of (for example adhering to) the profiled outer surface. In other words it is preferred that there is no further wrapper between the profiled outer surface of the downstream core and the inner surface of the stiff outer wrapper. Preferably the downstream thermoformed core is a core comprising a coherent, bonded, (smoke-permeable)material. Herein the term coherent means self supporting; the coherent bonded thermoformed core material holds its shape and profiled surface without requirement for a shaped wrapper (to hold it in shape).

The further core may include a core wrapper engaged around the (e.g. longitudinally extending, substantially cylindrical) further core. The wrapper may be a paper, e.g. plugwrap paper.

The filter or filter element may optionally include additional (e.g. longitudinally extending, substantially cylindrical) core(s) (e.g. of tobacco smoke filtering material) longitudinally aligned with the downstream thermoformed core and further core. The (or each) additional core may include a core wrapper engaged around the (e.g. longitudinally extending, substantially cylindrical) additional core. The wrapper may be a paper, e.g. plugwrap paper.

The profiled (e.g. corrugated) outer surface of the downstream (thermoformed) core may define with the (inner face of the) stiff outer wrapper,(e.g. covered) longitudinally extending channels (e.g. from one to sixteen longitudinally extending channels, preferably 4 to 10 channels, e.g. 5 to 10 channels) which extend continuously along the downstream thermoformed core (along the full length of the core). It will be appreciated that the exemplified numbers of channels above are preferred for a filter of circumference approximately 24.5 mm.

The applicants have found that the combination of the profiled (e.g. corrugated or grooved) thermoformed downstream core and the stiff outer wrapper (e.g. stiff plugwrap) gives better end definition than previous comparable products, because the grooves (channels) are not crushed or distorted during the subsequent processes of filter and filter cigarette manufacture and use. The thermoformed core does not require a further wrapper (e.g. air impermeable wrapper) following the profile of the profiled outer surface, and this may result in improved smoking qualities (e.g. by reducing or negating the "air and smoke" effect) because ventilating air may enter the downstream core and mix with the smoke.

The downstream end of the stiff outer wrapper may extend beyond the downstream end of the (downstream thermoformed) core around which it is engaged, to define an (e.g. substantially tubular) cavity at the downstream end of the filter or filter element. The radially inner face of the stiff outer wrapper which extends beyond the downstream end of the core around which it is engaged may define (e.g. with the downstream end of the downstream thermoformed core) a cavity or recess, e.g. a substantially tubular cavity/recess, at the downstream end of the filter or filter element. Thus, the filter or filter element may be a recess filter/filter element.

One or more of the downstream thermoformed core, the further core, the further core wrapper (if present), the stiff outer wrapper, the or each additional core (if present) and the or each additional core wrapper (if present) may optionally be coloured or tinted (e.g. using appropriate dyes or pigments, preferably those with regulatory approval for use in food contact applications). The further core may be of, or have a wrapper of, a contrasting colour to the colour of the downstream thermoformed core. The dye or pigment may preferably be any colour which contrasts with the (e.g. white) downstream thermoformed core of tobacco smoke filtering material, for example green, blue, red, orange etc. Each of the downstream thermoformed core, the further core and the additional core(s) if present may be of the same colour, or a different colour, to the other core(s). The further core and/or additional core may include a coloured or tinted wrapper (e.g. coloured using appropriate dyes or pigments, preferably those with regulatory approval for use in food contact applications).

In an example, the further core comprises a tobacco smoke filtering material which is coloured or tinted red (e.g. using appropriate dyes or pigments, preferably those with regulatory approval for use in food contact applications), and the downstream thermoformed core comprises white tobacco smoke filtering material (e.g. cellulose acetate). It will be appreciated that in this example the red colour of the further core will contrast with, and therefore be visible at the upstream end of the channel(s) in, the downstream thermoformed core, when the downstream end of the downstream core is viewed "end on" along the longitudinal axis of the filter/element. This contrast provides a product filter, element or rod with a distinctive appearance that is useful for anti-counterfeit purposes.

Thus, the distinctive end appearance provided by the downstream end of the downstream thermoformed core and stiff outer wrapper (optionally combined with coloured stiff outer wrapper, coloured further core, recessed downstream thermoformed core etc.) is robust (due to the strength of the wrapper and profiled surface), and remains a useful badge of origin and anti-counterfeiting measure during subsequent manufacture and smoking of e.g. filter cigarettes.

The downstream core of thermoformed tobacco smoke filtering material may be made of any thermoformed tobacco smoke filtering material. The filtering material may be, for example, natural or synthetic filamentary tow, e.g. of cotton or plastics such as polyethylene or polypropylene, cellulose acetate filamentary tow, and extruded material (e.g. starch, synthetic foams, extruded foams). Preferably the downstream thermoformed core of tobacco smoke filtering material comprises cellulose acetate, for example extruded filamentary cellulose acetate. The downstream thermoformed core of tobacco smoke filtering material may comprise a cellulose acetate tow, optionally including a plasticiser (e.g. glyceryl triacetate). The downstream thermoformed core may be formed by continuously advancing (e.g. continuously drawing and/or gathering) a flow of tobacco smoke filtering material (e.g. cellulose acetate tow, optionally including or bearing plasticiser) through a shaped die of suitable non-circular cross section which forms the core with profiled outer surface, and (optionally) heat treating the advancing core as and/or or shortly after it is formed (optionally with a subsequent cooling step)—e.g. by methods similar to those disclosed in WO2011/148130. The heat treatment (and optional cooling) may activate the plasticiser to form the filtering material into a coherent, bonded, smoke-permeable downstream thermoformed core having a profiled (e.g. grooved e.g. corrugated) outer surface.

The further core and additional core(s) if present may comprise a tobacco smoke filtering material. The tobacco smoke filtering materials for the cores may be the same or different. The tobacco smoke filtering material may be for example any of those materials (usually filamentary, fibrous, web or extruded) conventionally employed for tobacco smoke filter manufacture. The filtering material may be natural or synthetic filamentary tow, e.g. of cotton or plastics such as polyethylene or polypropylene, or cellulose acetate filamentary tow. It may be, for example, natural or synthetic staple fibres, cotton wool, web material such as paper (usually creped) and (e.g. synthetic) non-wovens, and extruded material (e.g. starch, synthetic foams, extruded foams). The filtering material of the further core and/or additional core(s) may be cellulose acetate.

As described above, the further (e.g. longitudinally extending, e.g. substantially cylindrical) core may comprise a tobacco smoke filtering material. Preferably the tobacco smoke filtering material is cellulose acetate. The further (e.g. longitudinally extending, e.g. substantially cylindrical) core may include a further core wrapper e.g. plugwrap, e.g. non-permeable plugwrap, engaged around the core. The further core may be a non-wrapped substantially cylindrical core of cellulose acetate, for example such as a non wrapped acetate (NWA) filter segment such as is well known in the art.

The further core and additional core(s) if present may include additive, e.g. particulate additive, e.g. activated carbon.

The tobacco smoke filter or filter element may include (bear) a flavouring agent. One or more of the downstream thermoformed core, the further core, the further core wrapper (if present), the stiff outer wrapper, the or each additional core (if present) and the or each additional core wrapper (if present) may include (bear) a flavouring agent. The flavouring agent may be any flavouring agent known for use in tobacco smoke filters or filter elements. For example, the flavouring agent may be menthol, spearmint, peppermint, nutmeg, cinnamon, clove, lemon, chocolate, peach, strawberry, vanilla etc. The agent may contain nicotine or a salt or derivative thereof. Preferably the flavouring agent is menthol. If more than one of the core(s)/wrapper includes flavouring agent, the flavouring agents may be the same or different.

The tobacco smoke filter or filter element may be of length 12 to 40 mm, e.g. 17 to 35 mm, e.g. 20 to 30 mm.

The tobacco smoke filter (or filter element) may be of circumference 14 to 28 mm, for example 16 to 26 mm, for example 16 to 17 mm or 24 to 25 mm.

In a filter cigarette according to the invention, a filter of the invention (or a filter which includes a filter element of the invention) is joined to a wrapped tobacco rod with one end of the filter (the upstream end) towards the tobacco. The filter may be joined to the wrapped tobacco rod by ring tipping [which engages around just the adjacent ends of the (wrapped) filter and rod to leave much of the filter wrap exposed]. The filter may be joined by a full tipping overwrap (which engages around the full filter length and the adjacent end of the tobacco rod).

Preferably the stiff outer wrapper includes ventilation, for example a region of ventilation. The stiff outer wrapper may include a region of ventilation comprising at least one ring or annulus of ventilation holes around the circumference of the filter/filter element. These ventilation holes may be in register with any of the segments that may be present in the filter. The stiff outer wrapper may include a region, or regions, of ventilation in register with the (or each) channel defined between the profiled (e.g. grooved e.g. corrugated) outer surface of the thermoformed core and the (inner surface of the) stiff outer wrapper. The inclusion of ventilation may result in further improved smoking qualities (e.g.

by further reducing or negating the "air and smoke" effect because ventilating air may more readily enter the downstream core).

The filter, filter element or filter cigarette according to the invention may be ventilated by methods well known in the art, e.g. by use of a pre-perforated or air-permeable stiff outer wrapper, and/or laser perforation of the stiff outer wrapper and, if present, tipping overwrap. A ventilating full tipping overwrap may likewise be inherently air-permeable or provided with ventilation holes, and in ventilated products where both stiff outer wrapper and tipping overwrap are present ventilation through the overwrap will usually (and preferably) be in register with that through the plugwrap. Ventilation holes through the stiff outer wrapper, or through a tipping overwrap, or through both simultaneously, may be made by laser perforation during filter or filter cigarette production, as is well known in the art.

The downstream thermoformed core may define one or more further channels or bores which extend longitudinally through the downstream thermoformed core. The further channel(s) or bore(s) may, for example, extend through the downstream thermoformed core from the downstream end. The further channel(s) or bore(s) may, for example, extend through the downstream thermoformed core from the downstream end to the upstream end. The (or each) further channel(s) or bore(s) may have a cross section of any shape, e.g. a circular, oval, star, heart, trilobal, pentagonal, cog or logo shaped cross section. Preferably the (or each) further channel(s) or bore(s) has a symetrical (symetrically shaped) cross section.

The downstream thermoformed core may define a single channel or bore which extends longitudinally through the downstream thermoformed core. The downstream thermoformed core may define more than one (e.g. narrow) channel or bore, rather than a single (broader) channel or bore. The downstream thermoformed core may define a channel or bore which preferably extends through the centre of the downstream thermoformed core (that is, along the central axis of the core). Preferably there is at least 1.2 mm of thermoformed material between the (periphery of the) further channel(s) or bore(s) and the closest part of the profiled outer surface to the (periphery of the) further channel(s) or bore(s).

According to the present invention in a further aspect there is provided a tobacco smoke filter element comprising a (longitudinally extending) thermoformed core of tobacco smoke filtering material having a profiled outer surface which includes at least one longitudinally extending groove which extends (e.g. continuously) the (full) length of the thermoformed core. The profiled (e.g. corrugated) outer surface of the (thermoformed) core may include from one to sixteen longitudinally extending grooves (preferably 4 to 10 grooves, e.g. 5 to 10 grooves) which extend (e.g. continuously) along the thermoformed core (along the full length of the core).

The filter element may further comprise a stiff outer wrapper engaged around the (longitudinally extending) thermoformed core of tobacco smoke filtering material. The profiled (e.g. grooved e.g. corrugated) outer surface may therefore define with the (inner surface of the) stiff outer wrapper at least one (e.g. covered) longitudinally extending channel which extends (e.g. continuously) the (full) length of the core (formed by the stiff outer wrapper covering the groove(s) in the outer surface of the core).

Preferably the stiff outer wrapper comprises a stiff paper, for example a stiff plugwrap paper. The stiff outer wrapper may be a paper (e.g. plugwrap paper) of basis weight from about 80 to 120 gsm. The stiff outer wrapper may be a paper (e.g. plugwrap paper) of lighter weight, for example of basis weight 30 to 80 gsm, to which additives have been applied to make it stiff, as well known in the art. Stiff papers, for example stiff plugwrap papers, are well known in the art.

Preferably the thermoformed core does not include a further wrapper (e.g. air impermeable wrapper) following the profiles of (for example adhering to) the profiled outer surface. In other words it is preferred that there is no further wrapper between the profiled outer surface of the core and the inner surface of the stiff outer wrapper (if present). Preferably the thermoformed core is a core comprising a coherent, bonded, (smoke-permeable) material (e.g. cellulose acetate). Herein the term coherent means self supporting; the coherent bonded thermoformed core material holds its shape and profiled surface without requirement for a shaped wrapper (to hold it in shape). Suitable materials for the thermoformed core are as described above for the downstream thermoformed core.

The total cross-sectional area of the longitudinally extending channels/grooves may amount to between 3 and 22%, preferably at least 5%, more preferably between 6 and 18%, of the overall cross-sectional area of the (downstream) thermoformed core of the filter. Careful control over the number and/or depth of the channels (e.g. determined by the thermoforming process which the downstream core is made) may give improved filtering performance and/or sensory characteristics. This may be achieved by increasing the depth of the corrugations, preferably with increase in surface area of the corrugations, and optionally along with increase in the corrugation pitch—that is widening of the corrugations with reduction in their number. For example, a filter according to the invention may have five channels which are about 0.75 mm deep and at a pitch of about 2.0 mm.

According to the invention in a further aspect there is provided a multiple rod comprising a plurality (e.g. 2, 4, 6 etc.) of filters (or filter elements) as described above and/or herein integrally joined end-to-end in a mirror image relationship.

Figure 2:
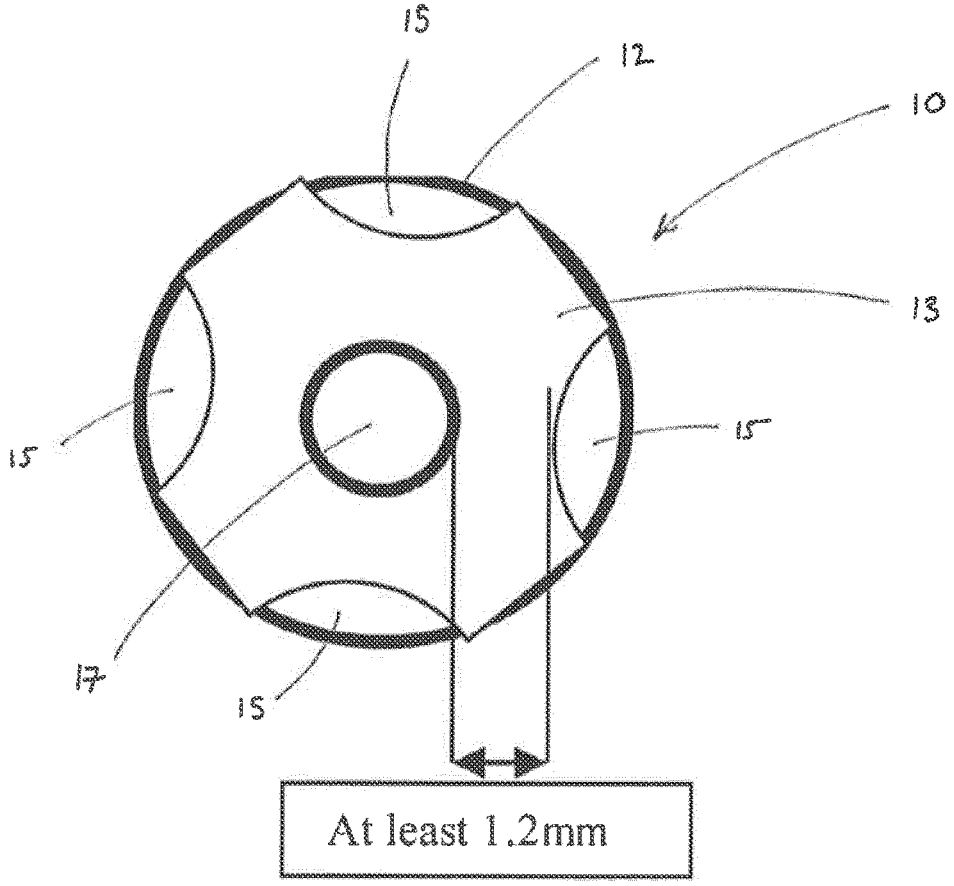

The present invention will now be illustrated with reference to the following Examples and the attached drawings in which FIG. 1 schematically illustrates a filter according to a first embodiment of the invention; and FIG. 2 shows the downstream end view of a filter according to a further embodiment of the invention.

FIG. 1 shows a tobacco smoke filter 1 of length 30 mm and circumference around 25 mm which includes a stiff outer wrapper 2 (shown by the dotted line) of stiff plugwrap paper of basis weight 100 gsm. The stiff outer wrapper is engaged around a downstream longitudinally extending thermoformed core 3 of tobacco smoke filtering material of length 15 mm; and a longitudinally extending substantially cylindrical further core 4 of tobacco smoke filtering material, also of length 15 mm. The further core 4 is longitudinally aligned with the thermoformed core 3 and the downstream end of the further core 4 is abutted to the upstream end of the downstream thermoformed core of tobacco smoke filtering material. The stiff outer wrapper includes ventilation (not shown).

The downstream thermoformed core 3 is formed from cellulose acetate tow to which a glyceryl triacetate plasticiser has been applied. The core 3 is formed in a multiple length of cores by continuously drawing and/or gathering a flow of tobacco smoke of cellulose acetate tow bearing plasticiser through a shaped die to form an advancing multiple length of cores with profiled outer surface, and heat treating the advancing multiple length of cores as and/or or shortly after it is formed (with a subsequent cooling step) by methods similar to those disclosed in WO2011/148130. The heat treatment and cooling activates the plasticiser to form the cellulose acetate material into a multiple length of coherent, bonded, smoke-permeable downstream thermoformed cores having profiled (e.g. grooved e.g. corrugated) outer surface. The multiple length of cores is then cut down to single cores 3 during filter or cigarette formation by methods well known in the art The downstream thermoformed core 3 has a profiled outer surface which includes four longitudinally extending grooves 5. Each groove 5 defines with the inner surface of the stiff outer wrapper a longitudinally extending channel (which is covered by the wrapper 2), which extends continuously the full length of downstream core 3.

The further core 4 is a non-wrapped substantially cylindrical core of cellulose acetate, for example such as a non wrapped acetate (NWA) filter segment, such as is well known in the art.

It will be appreciated that filters such as those illustrated in FIG. 1 may be made by methods well known in the art, by for example by longitudinally advancing a continuous flow of component multiple (e.g. dual) filter rods (arranged appropriately, e.g. with dual component rods which will form the downstream cores 3 located between dual component rods which will form the further cores 4) to a wrapping garniture where the continuously advancing stiff outer wrapper is wrapped around the longitudinally advancing flow of component multiple filter rods and fixed using a lapped and stuck seam (as is well known). The wrapped longitudinally advancing flow of component multiple filter rods is then cut appropriately for further use, by methods well known in the art.

The filter 1 is joined to a wrapped tobacco rod 6 with the upstream core 4 towards the tobacco. The filter 1 is joined to the wrapped tobacco rod 6 by ring tipping [which engages around just the adjacent ends of the (wrapped) filter and rod to leave much of the stiff wrapper 2 exposed], by methods which are well known in the art.

The applicants have found that the combination of the profiled thermoformed downstream core and the stiff outer wrapper gives better end definition than previous comparable products, because the covered channels are not crushed or distorted during the subsequent processes of filter and filter cigarette manufacture and use; this is useful for anti-counterfeit purposes. The thermoformed core is coherent and self supporting and therefore does not require a further wrapper (e.g. air impermeable wrapper) which follows the profiles of the profiled outer surface; this may result in improved smoking qualities (e.g. by reducing or negating the "air and smoke" effect) because ventilating air may enter the downstream core through the ventilation and/or longitudinally extending channels.

In a further example (not shown), a tobacco smoke filter similar to that illustrated in FIG. 1 includes a further NWA core which is coloured or tinted red (e.g. using appropriate dyes or pigments with regulatory approval for use in food contact applications), and the downstream thermoformed core comprises white cellulose acetate (as in FIG. 1). It will be appreciated that in this example the red colour of the further core will contrast with, and therefore be visible at the upstream end of the longitudinally extending channel(s) in, the downstream thermoformed core, when the downstream end of the downstream core is viewed "end on" along the longitudinal axis of the filter/element. This contrast provides a product filter, element or rod with an enhanced distinctive appearance that is useful for anti-counterfeit purposes.

FIG. 2 shows the downstream end view of a further embodiment of the invention. In this embodiment, tobacco smoke filter 10 of length 30 mm and circumference around 25 mm includes a stiff outer wrapper 12 (shown by the bold line) of stiff plugwrap paper of basis weight 100 gsm. The stiff outer wrapper is engaged around a downstream longitudinally extending thermoformed core 13 of tobacco smoke filtering material of length 15 mm; and a longitudinally extending substantially cylindrical further core of tobacco smoke filtering material, also of length 15 mm (not shown). The further core is longitudinally aligned with the thermoformed core 13 and the downstream end of the further core is abutted to the upstream end of the downstream thermoformed core 13 of tobacco smoke filtering material. The stiff outer wrapper includes ventilation (not shown).

The downstream thermoformed core 13 has a profiled outer surface which includes four longitudinally extending grooves 15. Each groove 15 defines with the inner surface of the stiff outer wrapper a longitudinally extending channel (which is covered by the wrapper 12), which extends continuously the full length of downstream core 13.

The downstream thermoformed core 13 defines a further channel or bore 17 of circular cross section which extends longitudinally through the downstream thermoformed core. The bore 17 extends through the downstream thermoformed core from the downstream end to the upstream end. As seen in FIG. 2, bore 17 extends through the centre of the downstream thermoformed core (that is, along the central axis of the core).

As shown in FIG. 2 (although not to scale), there is at least 1.2 mm of thermoformed material between the periphery of the bore 13 and the closest part of the profiled outer surface of core 13.

The downstream thermoformed core 13 is formed from cellulose acetate tow to which a glyceryl triacetate plasticiser has been applied, in a similar manner to that used to form thermoformed core 3 of the example of FIG. 1.

The further core (not shown) is a non-wrapped substantially cylindrical core of cellulose acetate, for example such as a non wrapped acetate (NWA) filter segment, such as is well known in the art.

The filter 10 may be joined to a wrapped tobacco rod with the upstream core towards the tobacco. The filter is joined to the wrapped tobacco rod by ring tipping [which engages around just the adjacent ends of the (wrapped) filter and rod to leave much of the stiff wrapper 2 exposed], by methods which are well known in the art.

The example of FIG. 2 has bore 17 of circular cross section. It will be appreciated that in other examples of the invention (not shown), the bore may have a cross section of any shape, e.g. a circular, oval, star, heart, trilobal, pentagonal, cog or logo shaped cross section. In other examples (not shown), the downstream thermoformed core may define more than one (e.g. narrow) bore, rather than a single bore.

The invention claimed is:

1. A tobacco smoke filter or filter element comprising a stiff outer wrapper engaged around a downstream thermoformed core of tobacco smoke filtering material and a further core separate from the downstream thermoformed core and longitudinally aligned therewith; the downstream thermoformed core having a profiled air permeable outer surface which defines with the stiff outer wrapper at least one longitudinally extending channel which extends a length of the downstream thermoformed core, wherein no further wrap is positioned between the profiled outer surface of the downstream thermoformed core of tobacco smoke filtering material and the stiff outer wrapper, wherein the stiff outer wrapper has a basis weight from about 80 to 120 gsm, wherein a terminal edge of the downstream end of the stiff outer wrapper surrounds the downstream end of the downstream thermoformed core around which the stiff outer wrapper is engaged.

2. The tobacco smoke filter or filter element according to claim 1, wherein the stiff outer wrapper comprises a stiff paper.

3. The tobacco smoke filter or filter element according to claim 1, further including a core wrapper engaged around the further core.

4. The tobacco smoke filter or filter element according to claim 1, further including at least one additional core longitudinally aligned with the downstream thermoformed core and the further core.

5. The tobacco smoke filter or filter element according to claim 1, wherein the profiled outer surface of the downstream thermoformed core defines with the stiff outer wrapper 1 to 16 longitudinally extending channels which extend along the length of the downstream thermoformed core.

6. The tobacco smoke filter or filter element according to claim 1, wherein the profiled outer surface of the downstream thermoformed core defines with the stiff outer wrapper 4 to 10 longitudinally extending channels which extend along the length of the downstream thermoformed core.

7. The tobacco smoke filter or filter element according to claim 1, wherein at least one of the downstream thermoformed core, the further core, and the stiff outer wrapper is coloured or tinted.

8. The tobacco smoke filter or filter element according to claim 1, wherein at least one of the further core and the stiff outer wrapper is a contrasting colour to a colour of the downstream thermoformed core.

9. The tobacco smoke filter or filter element according to claim 1, wherein the downstream thermoformed core of tobacco smoke filtering material comprises natural or synthetic filamentary tow, cellulose acetate filamentary tow, or extruded material.

10. The tobacco smoke filter or filter element according to claim 1, wherein the downstream thermoformed core of tobacco smoke filtering material comprises a cellulose acetate core formed by continuously advancing a flow of cellulose acetate through a shaped die of suitable cross section to form the downstream thermoformed core with the profiled outer surface.

11. The tobacco smoke filter or filter element according to claim 1, wherein the further core is individually selected from a natural or synthetic filamentary tow; a natural or synthetic staple fibre; cotton wool; web material; and extruded material.

12. The tobacco smoke filter or filter element according to claim 1, wherein the further core includes additive.

13. The tobacco smoke filter or filter element according to claim 1 which includes a flavouring agent.

14. The tobacco smoke filter or filter element according to claim 1 which includes ventilation.

15. The tobacco smoke filter or filter element according to claim 1, wherein the downstream thermoformed core defines at least one further channel or bore which extends longitudinally through the downstream thermoformed core.

16. The tobacco smoke filter or filter element according to claim 15, wherein there is at least 1.2 mm of thermoformed material between the at least one further channel or bore and a closest part of the profiled outer surface.

17. A filter cigarette comprising a filter or a filter including a filter element according to claim 1, joined to a wrapped tobacco rod.

18. A multiple rod comprising a plurality of filters or filter elements according to claim 1 integrally joined end-to-end in a mirror image relationship.

19. The tobacco smoke filter or filter element according to claim 1, wherein the terminal edge is positioned in line with the downstream end of the downstream thermoformed core.

* * * * *